United States Patent [19]

Bailey

[11] 4,250,146

[45] Feb. 10, 1981

[54] CASELESS MONOLITHIC CATALYTIC CONVERTER

[75] Inventor: Charles H. Bailey, Mt. Prospect, Ill.

[73] Assignee: UOP Inc., Des Plaines, Ill.

[21] Appl. No.: 82,437

[22] Filed: Oct. 5, 1979

[51] Int. Cl.[3] ..... F01N 3/10

[52] U.S. Cl. ..... 422/179; 60/299; 422/180

[58] Field of Search ..... 422/177, 179, 180, 221; 60/299, 322

[56] References Cited

U.S. PATENT DOCUMENTS

| | | | |
|---|---|---|---|
| 3,891,396 | 6/1975 | Musall et al. | 422/179 |
| 3,948,611 | 4/1976 | Stawsky | 422/179 |
| 4,032,310 | 6/1977 | Ignoffo | 422/177 X |
| 4,161,509 | 7/1979 | Nowak | 422/179 |

FOREIGN PATENT DOCUMENTS

| | | | |
|---|---|---|---|
| 2746676 | 4/1978 | Fed. Rep. of Germany | 60/322 |

*Primary Examiner*—William A. Cuchlinski, Jr.
*Attorney, Agent, or Firm*—James R. Hoatson, Jr.; Barry L. Clark; William H. Page, II

[57] ABSTRACT

Catalytic converter assembly which has no case around the monolith element is retained between its inlet and outlet plenums by a plurality of spring loaded retaining members. The design eliminates the necessity for the usual wire mesh mounting material and the failures which can result when the mesh overheats. The design also simplifies catalyst replacement, eliminates by-pass leakage and reduces weight and expense.

3 Claims, 2 Drawing Figures

CASELESS MONOLITHIC CATALYTIC CONVERTER

BACKGROUND OF THE INVENTION

The invention relates to catalytic converters and especially to the type which utilizes a monolithic ceramic honeycomb element to contact the gases to be purified. Such elements are typically mounted in a rigid stainless steel housing having inlet and outlet plenums at opposite ends for connecting the structure into an exhaust system. To help counteract the dimensional changes which occur between the ceramic monolith and the housing during heating and cooling cycles, a layer or blanket of compressed knitted metal wire mesh is usually present in the space between the monolith and housing. The knitted wire mesh presents a large contact area with the sides of the monolith which, presumably, will apply a sufficient resilient force during the life of the unit to resist axial movement of the monolith by exhaust gas pulses. Where contact area and contact pressure is reduced, such as by the mesh losing its resiliency by being overheated, or by oxidation, the monolith can be destroyed. This destruction takes place due to the attrition produced by the ends of the poorly supported monolith hammering on the ends of the housing under the pressure of the exhaust gas pulses.

If the need for metal mesh and a heavy metal housing could be eliminated, a substantial savings in weight as well as cost should be achievable.

SUMMARY

It is among the objects of the present invention to provide a catalytic converter assembly which does not utilize a metal case or metal mesh around the monolithic element. It is another object to provide a catalytic converter assembly which eliminates by-pass leakage, which can accommodate large increases in backpressure, and which permits simple replacement of the monolith element.

These objects and others are provided by the assembly of the present invention wherein a monolith element is mounted between a pair of end supports by a plurality of spring biased members such as bolts. The peripheral edges of the ends of the monolith are preferably in contact with high temperature gaskets which may be made of ceramic or metal fibers or a combination of each. The gaskets evenly distribute the end contact force to the monolith and prevent by-pass leakage. The lack of a housing facilitates the cooling of the ceramic monolith element and reduces the possibility of a burnout thereof. The particular mounting arrangement utilizing bolts and springs accommodates large changes in internal pressure, such as that caused by a backfire, where pressures in the order of 20–30 psi can be developed. The mounting also greatly facilitates changing of the monolith element should it be damaged, such as by catalyst poisoning or by a melt-out.

Although the caseless converter of the present invention could be used as a substitute for the usual converter in many situations, one where it might be especially advantageous would be between an engine block and its exhaust manifold. In such a situation the "light-off" time of the catalyst would be very rapid due to the close proximity of the catalyst element to the firing chambers and the isolation of the heavy metal manifold which normally draws much heat from the engine block of a cold engine. Thus, the pollutants entering the atmosphere during a "cold-start" could be greatly reduced. The uncased mounting of the catalyst elements would also reduce the chance of their being overheated and damaged.

DESCRIPTION OF THE PREFERRED EMBODIMENT

Figure 1:
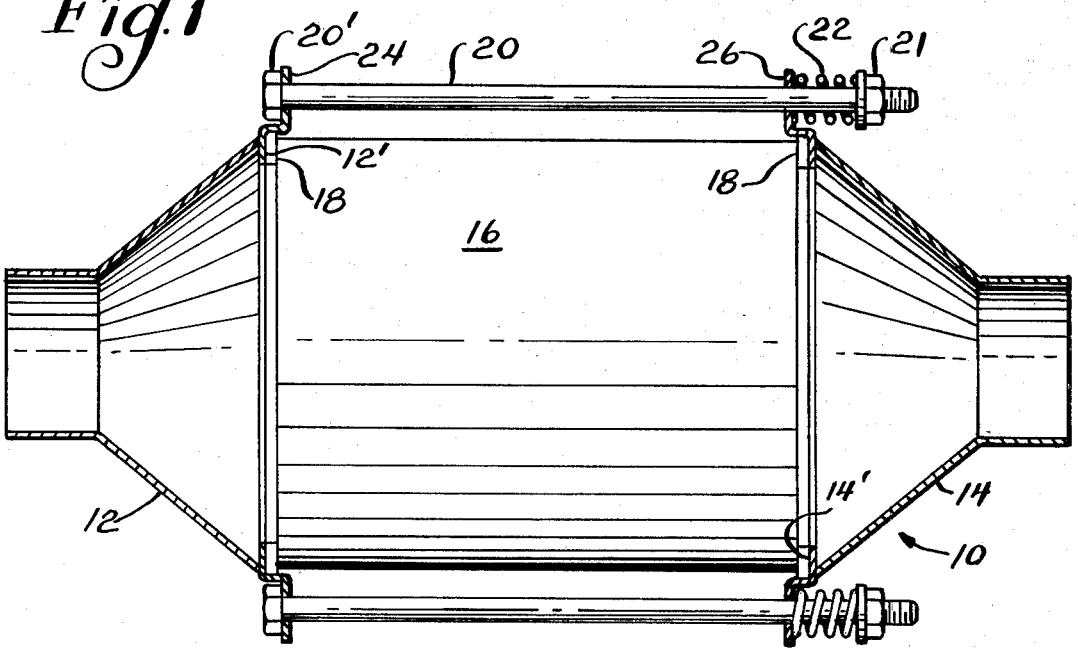
FIG. 1 is a side view, partially in section, illustrating my improved structure for retaining a catalyst element.
Figure 2:
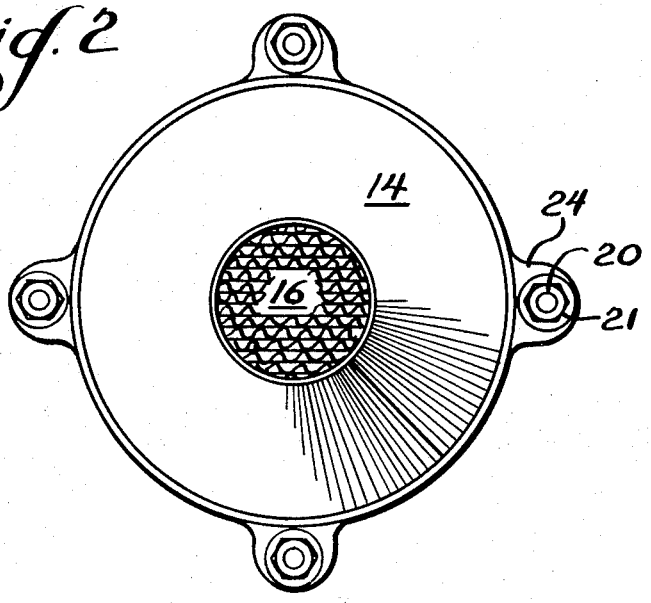
FIG. 2 is an end view of the structure illustrated in FIG. 1.

Referring to the drawings, a preferred embodiment of my invention is indicated generally at 10 and includes an inlet plenum 12, an outlet plenum 14, a ceramic, monolithic, catalyst support element 16, a pair of annular gasket members 18, and a plurality of stay bolts 20 and springs 22 which resiliently urge the plenums 12, 14 toward each other.

The stay bolts 20 and their heads 20' and nuts 21 engage flange portions 24, 26 on the plenums 12, 14 and resiliently squeeze the plenums into sealing contact with the gaskets 18 and support element 16 by means of the compression springs 22. The plenums have recessed portions 12', 14' which capture the gaskets 18 and prevent radial movement of the element 16. The amount of spring force exerted by springs 22 should be sufficient to accommodate any temperature expansion of the metal bolts 20 relative to the ceramic element 16 during operation and sufficient to withstand the pressure of exhaust gas pulses such as a backfire. Since the design permits bolts 20 to remain relatively cool, the springs 22 could also be in the form of a wavy washer for those situations where the amount of expansion to be accommodated is relatively small. The amount of heat expected would determine the type of materials used in construction. For example, the bolts 20 could be made of carbon steel where extremely hot temperatures are not anticipated. For higher temperature use, bolts made of inconel would be preferred. The plenums 12, 14 are preferably made of stainless steel while the gaskets 18 could be formed of ceramic fibers, metal fibers, or a combination of the two. Although the assembly 10 is illustrated as being circular, it could have other shapes, such as oval, for example.

I claim as my invention:

1. A caseless catalytic converter assembly comprising a first end support member; a ceramic, monolithic catalyst support element having a plurality of parallel flow channels therein; a second end support member; at least one generally annular gasket member overlying a portion of at least one of said end support members; said catalyst support element being positioned between said first and second end support members and in sealing engagement with said at least one gasket member; a plurality of at least three fastening members and at least three springs mounted in a uniformly spaced manner around the outer surface of said catalyst support element, said fastening members and springs being mounted to said end support elements so as to exert a resilient force thereon which tends to draw said end support elements toward each other and into sealing relationship with said catalyst support element and said at least one gasket element positioned therebetween.

2. The assembly of claim 1 wherein said end support members comprise inlet and outlet plenums, the facing portions of the respective plenums each having a recessed annular ring portion for receiving an annular gasket member.

3. The assembly of claim 2 wherein said fastening members are elongated bolts and complementary nuts.

* * * * *